US005746086A

United States Patent [19]

Palmqvist

[11] Patent Number: 5,746,086

[45] Date of Patent: May 5, 1998

[54] DRIVING DEVICE WITH FORCE-LIMITING ELEMENT FOR A BENDING UNIT

[75] Inventor: Peter Palmqvist, Olofström, Sweden

[73] Assignee: AB Volvo, Goteborg, Sweden

[21] Appl. No.: 676,280

[22] PCT Filed: Dec. 22, 1994

[86] PCT No.: PCT/SG94/01246

§ 371 Date: Jul. 18, 1996

§ 102(e) Date: Jul. 18, 1996

[87] PCT Pub. No.: WO95/19856

PCT Pub. Date: Jul. 27, 1985

[30] Foreign Application Priority Data

Jan. 25, 1994 [SE] Sweden ..... 9400219

[51] Int. Cl.[6] ..... B21J 9/18; B21D 5/00

[52] U.S. Cl. ..... 72/450; 72/452.5; 100/280

[58] Field of Search ..... 72/450, 451, 380, 72/381, 452.5; 100/271, 280, 281; 29/243.5

[56] References Cited

U.S. PATENT DOCUMENTS 2,726,702 12/1955 Laxo .
2,847,051 8/1958 Renard .
4,706,489 11/1987 Dacey, Jr. ..... 72/450
5,050,422 9/1991 Dorsett ..... 72/450
5,315,855 5/1994 Jackson .

FOREIGN PATENT DOCUMENTS 106651 11/1899 Germany .
1402555 4/1969 Germany .
2 252 067 4/1981 Germany .
WO 89/09100 10/1989 WIPO .
WO 92/11956 7/1992 WIPO .

*Primary Examiner*—David Jones
*Attorney, Agent, or Firm*—Young & Thompson

[57] ABSTRACT

A driving device for a bending unit for bending-in an edge flange against a workpiece. The bending unit comprises a stand, supporting the driving device, a supporting surface for the workpiece and a linkage system, which supports a bending tool for the movement along a predetermined path of movement. A motor (14) is mounted on the stand (1) and is coupled to a crankshaft (23) mounted in the stand. The crankshaft supports on a crank pin (25) one end of a connecting rod (26), the other end of which is articulated to a link (8) in the linkage system. The connecting rod (26) is movable, by rotation of the crankshaft (23), between a rest position, in which it keeps the linkage system (8) and the tool in a deactivated position, and a work position, in which it keeps the linkage system (8) and the tool in an end position, where bending-in of the edge flange is completed.

8 Claims, 2 Drawing Sheets

DRIVING DEVICE WITH FORCE-LIMITING ELEMENT FOR A BENDING UNIT

FIELD OF THE INVENTION

The invention relates to a driving device for a bending unit for bending-in a projecting edge flange against a surface of a workpiece, said bending unit comprising a stand, which carries both the driving device and a supporting surface for the workpiece as well as a linkage system, which in turn supports a bending tool in such a manner that the tool is movable relative to the workpiece placed on the supporting surface along a predetermined path of movement.

BACKGROUND OF THE INVENTION

Bending units of the above mentioned type are well known in a number of different designs, and they are used to bend in, for example, an edge flange on a sheet metal piece around the edge of another sheet metal piece to create a type of folded seam for joining the two metal pieces to each other. Operations of this type are common, for example in the automobile industry to manufacture doors, engine hoods and similar body parts. A common type of driving device for such a bending unit comprises a hydraulic cylinder, which is coupled between the frame and the link system. Extending or retracting the piston rod of the hydraulic cylinder acts on the linkage system to give the tool the desired path of movement and achieve the required force so that the tool will be able to carry out the desired bending operation. In addition to the driving device itself, a hydraulic unit is required to provide the required hydraulic pressure as well as hydraulic lines and control equipment.

SUMMARY OF THE INVENTION

The purpose of the invention is to achieve a new type of driving device for a bending unit of the type described by way of introduction, said driving device being of simple construction and having reliable operation as well as requiring very little space. This is achieved according to the invention by virtue of the fact that a motor is mounted on the stand and is coupled to a crankshaft mounted in the stand, said crankshaft carrying on a crank pin one end of a connecting rod, the other end of which is articulated to a link in the linkage system, said connecting rod being movable by rotation of the crankshaft between a rest position, in which it keeps the linkage system and thereby the tool in a deactivated position, and a work position, in which it keeps the linkage system and the tool in an end position, where bending-in of the edge flange is completed.

BRIEF DESCRIPTION OF THE INVENTION

The invention will be described in more detail below with reference to the accompanying drawings, which show one embodiment of the invention and in which FIG. 1 is a schematic side view of a bending unit with a driving device according to the invention, FIG. 2 is a schematic view of the device according to FIG. 1 as seen in the direction of the arrow 2 in FIG. 1, only a small portion of the bending unit being shown, FIG. 3 is a frontal view, partially cut away, showing a portion of the driving device according to FIG. 2, and FIG. 4 shows a section along the line IV—IV in FIG. 3.

DETAILED DESCRIPTION OF THE INVENTION

Figure 1:
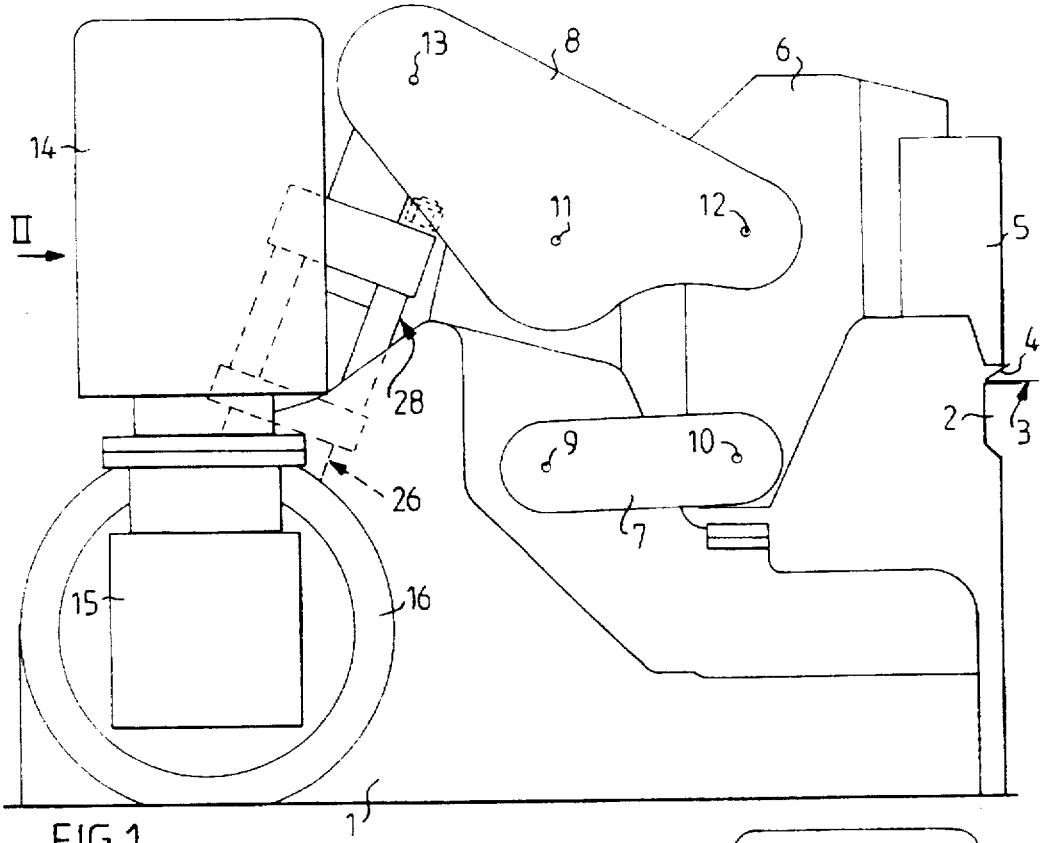

FIG. 1 shows a bending unit made up of a stand 1, on which there is disposed a supporting surface 2 for a workpiece 3 with an edge flange 4, which is to be bent-in towards the main portion of the workpiece 3 with the aid of a tool 5. The tool 5 is held in a tool holder 6, which in turn is carried by a linkage system with two links 7 and 8. The link 7 is articulated via two pivot points 9 and 10, respectively, to the stand 1 and the tool holder 6, respectively. The link 8 is articulated at the pivot points 11 and 12, respectively, to the frame 1 and the tool holder 6, respectively. The link 8 also has a pivot point 13 for connecting a drive unit, as will be described in more detail below. The links 7 and 8 form together with the frame I and the tool holder 6 a linkage system which makes it possible to move the tool holder 6 relative to the frame 1 and the supporting surface 2 so as to move the tool 5 towards and away from the workpiece 3.

The bending device described above and shown schematically in FIG. 1 is of a type which is known per se and is only intended to provide an example of a type of bending unit where the driving unit according to the invention can be used. A number of other types of bending devices are known in which the driving device according to the invention can be used, but these are not shown or described in more detail here.

The driving device according to the invention is only shown schematically in FIG. 1, but it is evident therefrom that it comprises an electric motor 14, which is mounted via a transmission 15 in the stand 1.

Figure 2:
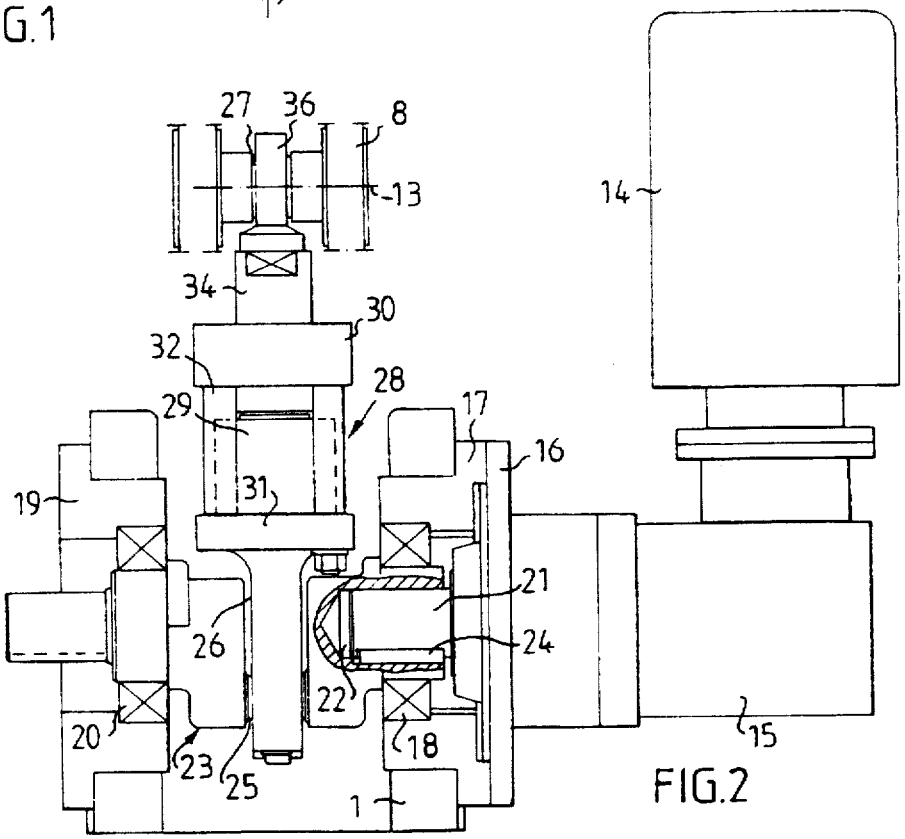

It can be seen in FIG. 2 that the transmission 15 is fixed with the aid of a flange 16 to a bearing mounting 17 which is mounted in the frame 1. A bearing 18, which in the embodiment shown is a roller bearing, is mounted in the bearing mounting 17. Spaced from the bearing mounting 17 and coaxial therewith is a second bearing mounting 19, which is also mounted in the frame 1 and carries a bearing 20, which in the embodiment shown is a roller bearing.

The bearings 18 and 20 are arranged coaxial with each other and with an output shaft end 21 from the transmission 15. The shaft end 21 extends into a socket 22 in one end of a crank-shaft 23 and is joined to the crankshaft 23 by means of a key 24.

The crankshaft 23 is mounted in the bearings 18 and 20 and is rotatable with the aid of the electric motor 14, the transmission 15, the shaft end 21 and the key 24.

The crankshaft 23 is made with a crank pin 25, on which a connecting rod 26 is rotatably mounted at one end. The other end of the connecting rod 26 is connected to the pivot point 13 of the link 8 in the linkage system. The pivot point 13 is thus the axis of a pivot pin 27 extending between two parallel portions of the link 8.

When the crankshaft 23 is turned, the connecting rod 26 will rock the link 8 about the pivot point ii, so that the tool holder 6 and the tool 5, during one rotation of the crank-shaft 23, will complete a movement from a deactivated position, where the tool 5 is spaced from the workpiece 3, to an end position, where the tool 5 has performed the bending in of the edge flange 4, thereafter returning to the deactivated position.

In order to be able to avoid overloading different parts of the device due to different thicknesses of the workpieces 3 or as a result of foreign objects between the tool 5 and the supporting surface 2, a force-limiting device 28 is arranged in the force path between the bearing of the crankshaft 23 in the stand 1 and the tool 5. In the embodiment shown in the drawings, the force-limiting device 28 is built into the connecting rod 26 and constitutes a portion thereof. It is, however, also possible to arrange a corresponding force-limiting device at another location with a corresponding function.

The force-limiting device 28 comprises, in the embodiment shown in the drawings, a gas spring 29, i.e. a spring where the spring force is achieved by a gas enclosed in a pressure cylinder and acting on the piston. The gas spring is arranged between two plates 30 and 31, which are joined to each other by means of bolts 32 and kept at a predetermined distance from each other. The plate 30 is provided with a through-opening 33 through which there extends a rod 34. The rod 34 is provided at its end facing the gas spring 29 with a flange 35 of greater diameter than the opening 33. The rod 34 can therefore not be pulled out through the plate 30. At its free end outside the plate 30, the rod 34 is provided with an end piece 36 for mounting on the pivot pin 27. The rod 34 is in this way a portion of the connecting rod 26 and is usually pressed upwards by the gas spring 29, so that the flange 35 abuts against the plate 30. The rod 34 can, however, by overcoming the force of the gas spring 29, be pressed in the opposite direction, thus reducing the total length of the connecting rod 26.

Figure 4:
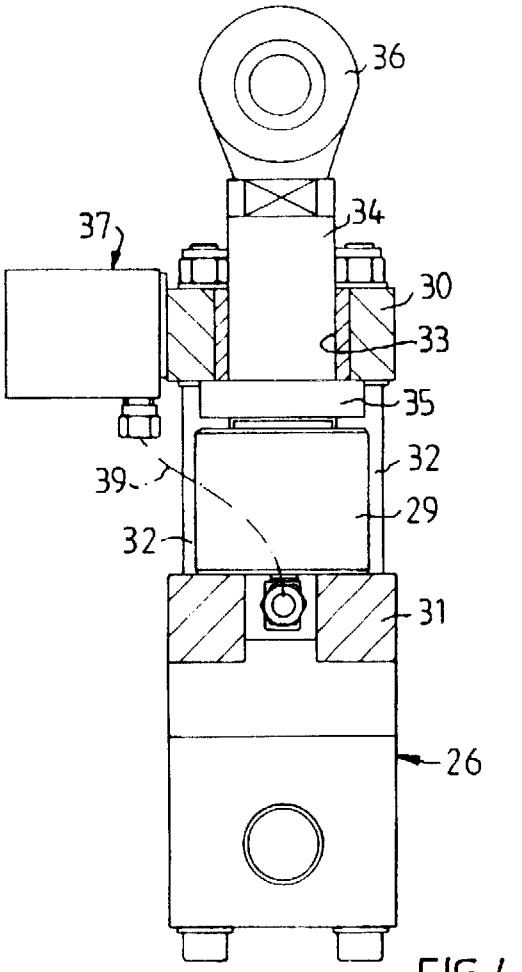
Figure 3:
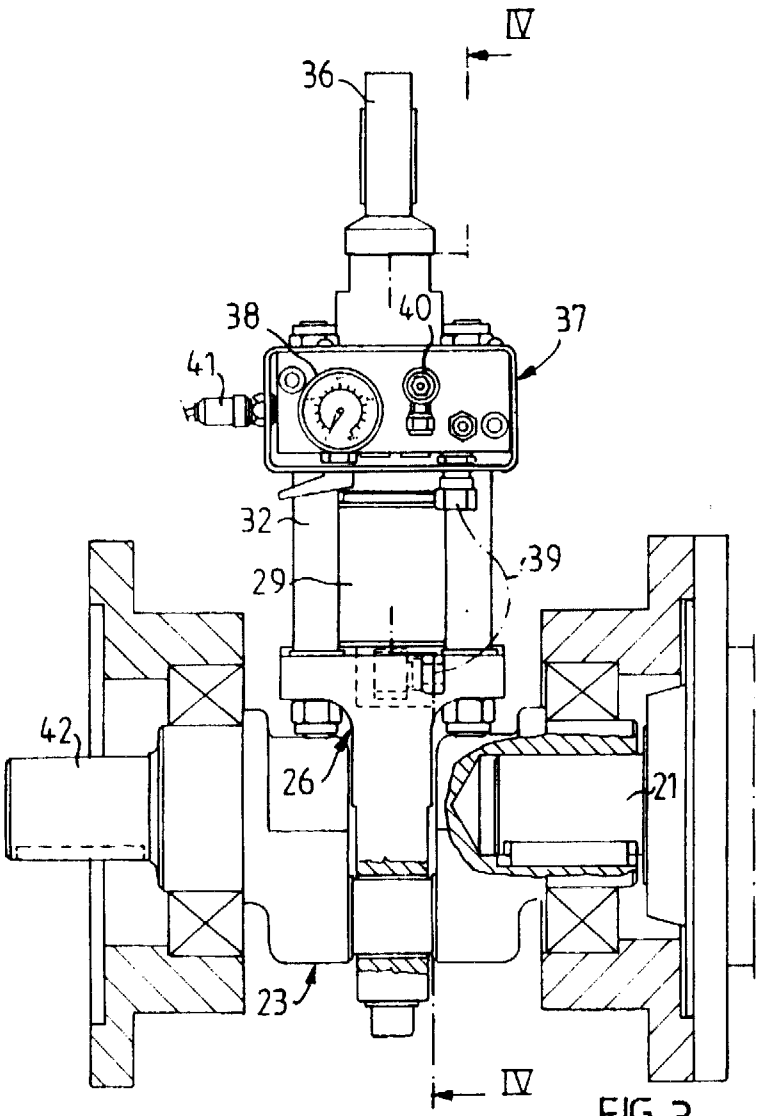

As can be seen in FIGS. 3 and 4, the plate 30 supports a control device 37 for the gas spring 29. The control device 37 is provided with an indicating means in the form of a manometer 38 for indicating the pressure in the gas spring 29. The manometer 38 is connected to the gas spring 29 by means of a line 39, which is only indicated by a dash-dot line. Furthermore, the control device 37 has a connection 40 to make it possible to increase or decrease the pressure in the gas spring 29 to control the spring force. Furthermore, there is in the control device 37 a sensor means for the pressure, said sensor means being connected via an electrical connection 41 to an indicating means to indicate if the pressure on the gas spring 29 deviates from the set value.

When the bending unit is to be used, the tool 5 is moved to a deactivated position, the driving device being shifted to a rest position, which essentially corresponds to that shown in FIG. 2. A workpiece 3 is thereafter placed on the supporting surface 2 and the motor 14 is engaged by means of the control means (not shown) of the bending unit. The motor 14 will thus turn the crankshaft 23, so that the connecting rod 26 is moved upwards, as seen in the drawings. Thus, the connecting rod 26 will rock the link 8 about the pivot point 11, which is fixed in the stand 1. The link 8 will thus transfer the movement to the tool holder 6 and the tool 5, so that the tool 5 will be moved downwards to bend in the edge flange 4. When the tool 5 has reached its end position, i.e. when the edge flange 4 is completely folded in towards the major portion of the workpiece 3, the connecting rod 26 has reached its final end position, so that the tool 5, if the crankshaft 23 continues to be turned, will be lifted from the workpiece 3.

Due to differences in size between different workpieces 3, and in order to achieve secure bending-in of the edge flange 4 with sufficient force, the geometry of the drive device is such that when the tool 5 reaches its final position, with its edge flange 4 completely bent in, the connecting rod 26 has not yet reached its upper end position. Upon continued turning of the crankshaft 23 past the upper end position of the connecting rod 26, the force-limiting means 28 will therefore be employed. If the predetermined load is exceeded, the gas spring 29 will be pressed together by the rod 34 sliding in the opening 33 and compressing the gas spring 29. This prevents overloading and damage to the component parts of the driving device and the bending unit, at the same time as satisfactory bending-in of the edge flange 4 is assured.

By changing the pressure in the gas spring 29, it is possible to adjust the size of the force which the tool 5 exerts against the edge flange 4. In this manner it is possible to adapt the bending force to current conditions.

As can be seen in FIGS. 2 and 3, the crankshaft 23 has at its end remote from the shaft end 21 a shaft end 42. With the aid of this shaft end 42, the crankshaft 23 can be coupled to a corresponding crankshaft in an adjacent drive unit, so that two or possibly more driving units can be driven with the same motor and gearbox. This can be an advantage if a number of bending units are to be arranged adjacent each other in confined spaces.

It should be noted that changes can be made within the scope of the invention. For example, the electric motor 14 can be replaced by any other type of motor. It is also conceivable that the electric motor or any other motor can be coupled directly to the crankshaft 23 without use of any gearbox.

I claim:

1. In a driving device for a bending unit for bending-in a projecting edge flange against a surface of a workpiece, the bending unit comprising a stand, which carries both the driving device and a supporting surface for the workpiece, and a linkage system which supports a bending tool in such a manner that the tool is movable relative to the workpiece placed on the supporting surface along a predetermined path of movement, the improvement wherein a motor is mounted on the stand and is coupled to a crankshaft mounted in the stand, said crankshaft carrying on a crank pin one end of a connecting rod, the other end of said connecting rod being articulated to a link in the linkage system, said connecting rod being movable by rotation of the crankshaft between a rest position, in which the connecting rod keeps the linkage system and the tool in a deactivated position, and a work position, in which the connecting rod keeps the linkage system and the tool in an end position, where bending-in of the edge flange is completed, and a force-limiting means operatively arranged in said driving device the mounting of the crankshaft in the stand and said linkage system, said force-limiting means being flexible after a predetermined load has been exceeded.

2. The driving device according to claim 1, wherein the motor is an electric motor.

3. The driving device according to claim 1, wherein the force-limiting means is built into the crankshaft as a component thereof.

4. The driving device according to claim 1, wherein the force-limiting means is a spring.

5. The driving device according to claim 4, wherein the spring is a gas spring.

6. The driving device according to claim 4, wherein the spring is provided with a device for controlling the spring force to change the predetermined load.

7. The driving device according to claim 4, further comprising an indicator means for indicating the current spring force of the spring.

8. The driving device according to claim 5, further comprising a pressure sensor means electrically connected to an indicator means for indicating if the pressure in the gas spring deviates from a predetermined value.

* * * * *